US005511698A

United States Patent [19]

Solignac

[11] Patent Number: 5,511,698

[45] Date of Patent: Apr. 30, 1996

[54] DEVICE FOR SPRAYING A PREDETERMINED DOSE OF A FLUID, AND A METHOD OF FILLING THE DEVICE

[75] Inventor: Philippe Solignac, Rouen, France

[73] Assignee: Etablissements Valois (Societe Anonyme), Le Neubourg, France

[21] Appl. No.: 170,326

[22] PCT Filed: Jun. 26, 1992

[86] PCT No.: PCT/FR92/00583

§ 371 Date: Feb. 16, 1994

§ 102(e) Date: Dec. 27, 1993

[87] PCT Pub. No.: WO93/00172

PCT Pub. Date: Jan. 7, 1993

[30] Foreign Application Priority Data

Jun. 26, 1991 [FR] France ..... 91 07854
Jul. 10, 1991 [FR] France ..... 91 08624

[51] Int. Cl.[6] ..... B05B 11/02; B05B 11/00

[52] U.S. Cl. ..... 222/162; 222/386; 222/321.1; 141/2; 239/320; 239/331; 53/79; 53/274; 53/510

[58] Field of Search ..... 222/386, 319–321, 222/162, 321.1; 239/320, 331; 141/2, 3, 7, 20, 21, 25–27, 8; 53/405, 79, 88, 274, 432, 470, 510

[56] References Cited

U.S. PATENT DOCUMENTS

| | | | |
|---|---|---|---|
| 3,350,839 | 11/1967 | Carter | 53/88 |
| 3,824,762 | 7/1974 | Walles | 53/88 |
| 4,597,245 | 7/1986 | Parker | 53/510 |
| 4,726,747 | 2/1988 | Skorka | 222/321 X |
| 4,921,142 | 5/1990 | Graf et al. | 222/162 |
| 5,031,800 | 7/1991 | Brunet | 222/162 X |
| 5,257,726 | 11/1993 | Graf et al. | 222/320 |
| 5,339,595 | 8/1994 | Rouse et al. | 53/88 |
| 5,368,201 | 11/1994 | Fuchs | 222/162 |

*Primary Examiner*—J. Casimer Jacyna
*Attorney, Agent, or Firm*—Sughrue, Mion, Zinn, Macpeak & Seas

[57] ABSTRACT

A device for spraying a single dose of a fluid in divided form includes a cylindrical tank (1) containing the dose of fluid, a piston (2) sliding in the cylindrical tank (1), a pusher for the piston (2), and outlet passage (5, 6) capable of communicating with the cylindrical tank (1). The piston (2) is displaceable relative to the pusher between a storage position, in which it prevents communication between the outlet passage (5, 6) and the cylindrical tank (1), and an actuation position, in which it puts the outlet passage (5, 6) into communication with the cylindrical tank (1). According to one aspect of the invention, the piston (2) is maintained in its storage position by wedging.

25 Claims, 8 Drawing Sheets

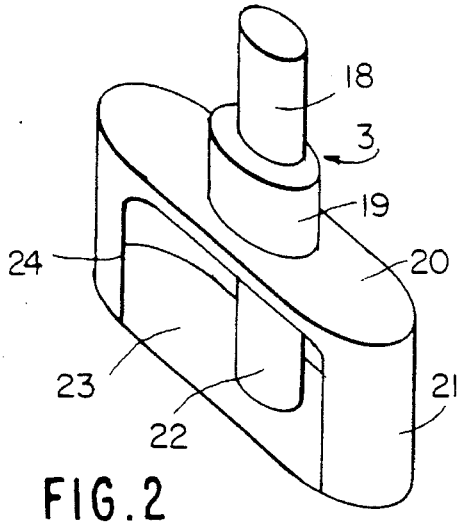
FIG.2
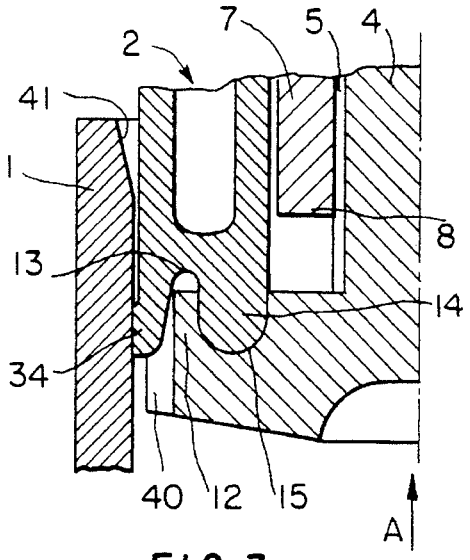
FIG.3
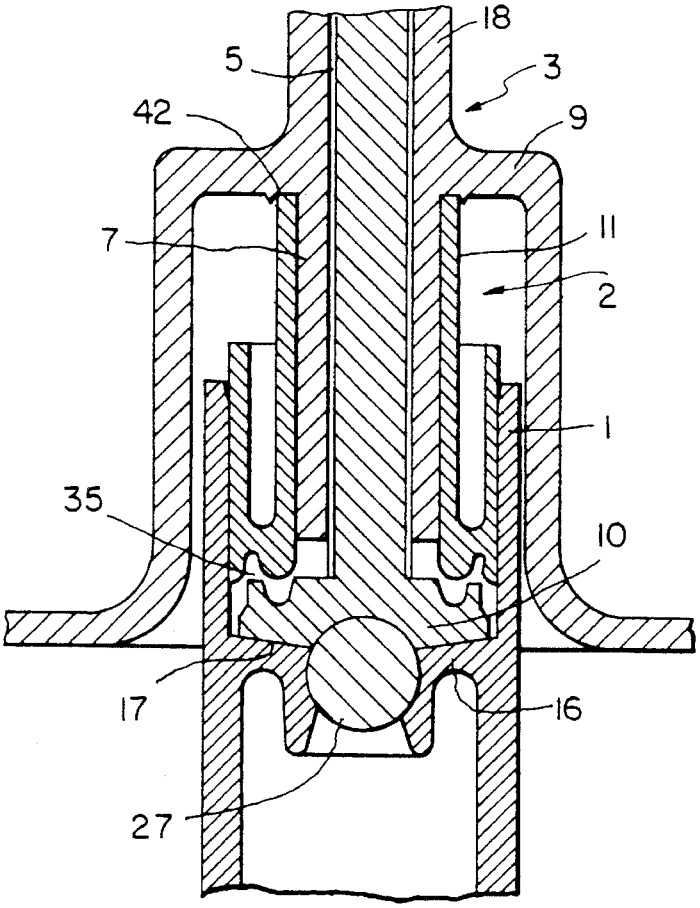
FIG.4
FIG.3A
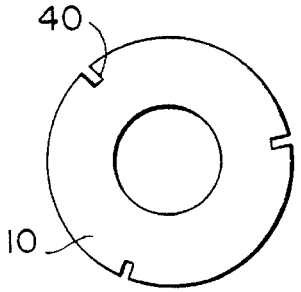
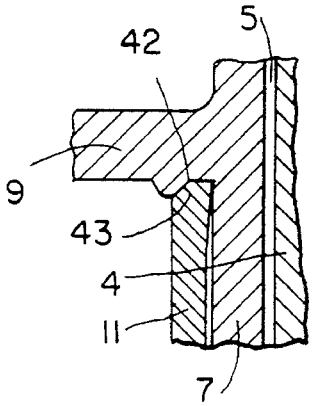
FIG.4A FIG. 15
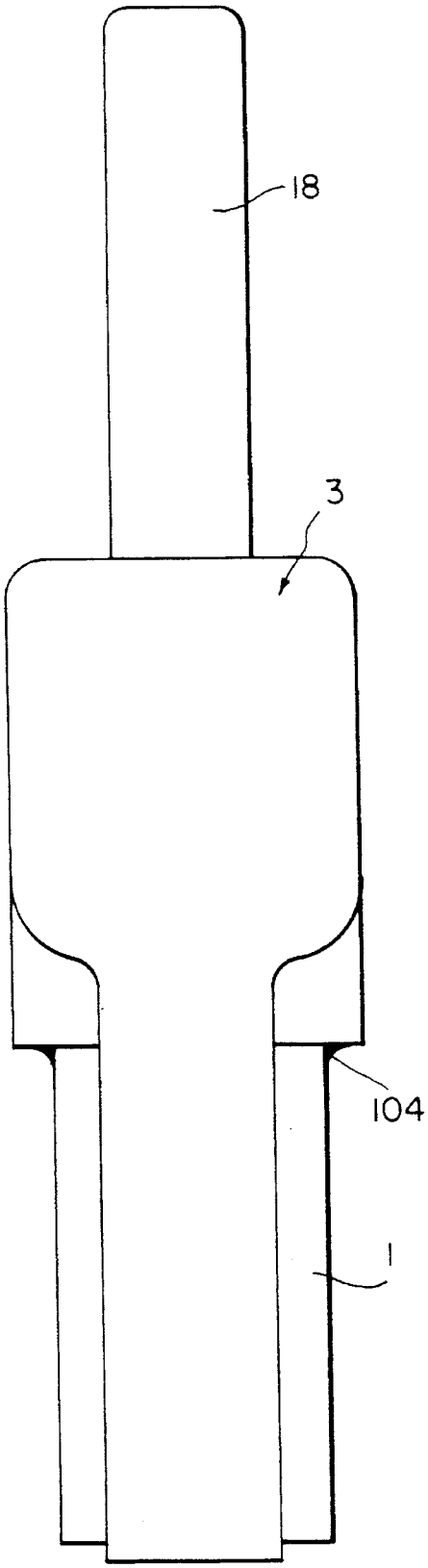
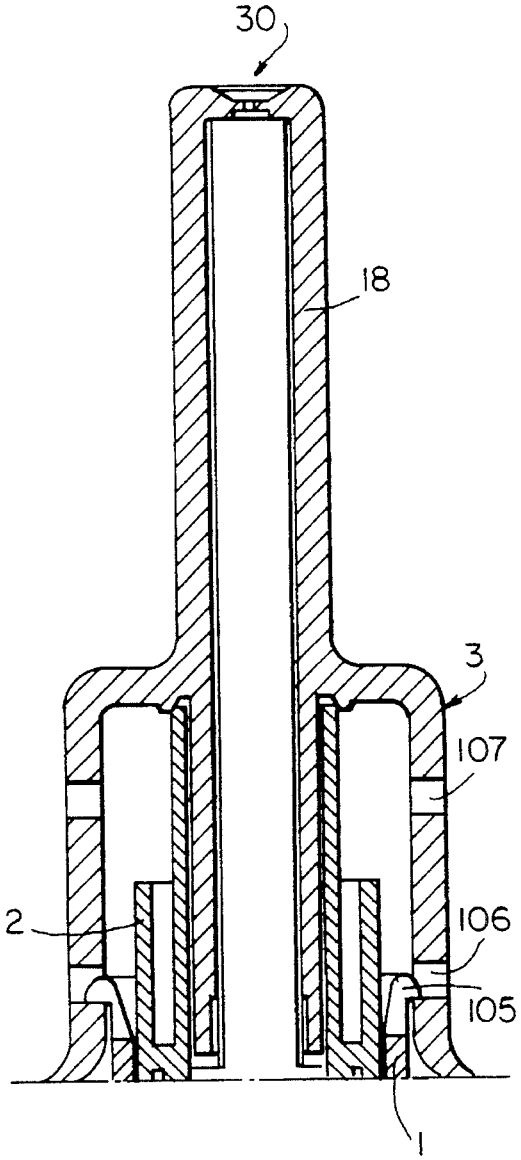
FIG. 16

DEVICE FOR SPRAYING A PREDETERMINED DOSE OF A FLUID, AND A METHOD OF FILLING THE DEVICE

BACKGROUND OF THE INVENTION

1. Field of the Invention

The invention relates to a device for spraying a predetermined dose of a fluid, and to a method of filling the device. More particularly, the invention relates to a device containing a single dose of fluid and suitable for discarding after said dose has been dispensed. The fluid to be sprayed may be a medicine, a cosmetic, or the like. The device of the invention is more particularly intended for spraying into the nose, but it could be used for other purposes: spraying into the ear, under the tongue, etc.

2. Discussion of the Related Art

The single dose may optionally be subdivided into a plurality of subdoses, as disclosed in Document EP-A-0 311 863.

Such devices are known in the state of the art. For example, document EP-A-0 311 863 describes a device comprising a cylindrical tank of fluid in which there slides a piston which is secured to an actuator pusher. The device also includes an outlet passage in communication with the tank of fluid. However that outlet passage is not airtight so the fluid contained in the tank may oxidize or become polluted in contact with the air during storage.

SUMMARY OF THE INVENTION

A particular object of the present invention is to avoid that drawback, but without significantly increasing the cost of the device which is suitable for discarding after being actuated a single time.

The present invention therefore provides a device for spraying a single dose of a fluid in divided form, the device. comprising at least:

a cylindrical tank containing said dose of fluid;

a piston slidable in said cylindrical tank;

actuator means for actuating the piston; and an outlet passage capable of communicating with said cylindrical tank, said piston being displaceable relative to said actuator means between a storage position in which it prevents communication between said outlet passage and said cylindrical tank, and an actuation position in which it puts said outlet passage into communication with the cylindrical tank the piston being placed so that a pressure obtaining in the cylindrical tank attracts the piston towards its actuation position, characterized in that tho piston is held in its storage position by wedging, and can be displaced towards its actuation position only if the pressure that obtains inside the cylindrical tank is sufficient for unwedging it.

In a particular embodiment of the invention, the actuator means comprise a cylindrical portion that extends between an end close to the cylindrical tank and an abutment that is further from the cylindrical tank, said end close to the fluid tank is secured to a ring, said fluid outlet passage is disposed at least in part inside said cylindrical portion of the actuator means, said fluid outlet passage opens out from said cylindrical portion between said ring and said abutment in the vicinity of said ring, the piston includes an internal sleeve that slides over said cylindrical portion of the actuator means, and said piston is in sealing contact with said ring while in the storage position.

Advantageously, the piston includes an outside peripheral sealing lip which slides in sealed manner inside the cylindrical tank and which is wedged between said tank and the ring when the piston is in its storage position. In a particular embodiment, the ring includes an annular rib extending towards the piston, the piston includes an annular groove adapted to receive the rib of the ring, the piston includes an annular rib directed towards the ring and inside said annular groove, and the ring includes an annular groove adapted to receive the annular rib of the piston. In which case, the ring may include at least one passage putting the tank into communication with the groove of the piston when said piston is in its storage position, and the rib of the piston is in sealing contact with the groove of the ring.

Advantageously, the cylindrical tank includes an end wall, and the ring includes a face facing towards said end wall and substantially complementary in shape to said end wall, and said face of the ring comes into abutment against said end wall at the end of the stroke of the piston, such that substantially all of the fluid contained in the tank is expelled.

The piston may optionally be urged towards its storage position by resilient means.

The internal sleeve of the piston may be pressed against the abutment of the actuator means when the piston is in its storage position, and the displacement of the piston towards its actuation position takes place by deformation of at least a portion of the internal sleeve. Advantageously, the internal sleeve of the piston then includes longitudinal slits over a fraction of its length in the vicinity of said abutment of the actuator means so as to facilitate deformation of said internal sleeve.

The sleeve may be pressed in sealed contact against said abutment of the actuator means when the piston is in its actuation position. Advantageously, said abutment includes a concave annular surface surrounding the cylindrical wall with its concave side facing towards the sleeve, and said concave annular surface deforms radially towards the inside of a free end of said sleeve when the piston is in its actuation position. In a variant, the sleeve of the piston may slide in sealed manner over the cylindrical wall of the actuator means.

In a particular embodiment, the piston includes a cylindrical portion which slides over a complementary cylindrical portion of the ring while continuing to interrupt communication between the cylindrical tank and the fluid outlet passage so long as the piston has not moved away from the ring by a predetermined distance.

In another particular embodiment of the invention, the cylindrical fluid tank includes a filler orifice suitable for receiving a plugging bead, and said orifice is extended towards the outside of the tank by a duct provided with longitudinal slits, said bead being capable of being received as a force-fit inside said duct in an intermediate position where it allows the tank to communicate with the outside via said longitudinal slits.

The present invention also provides a method of filling the above-specified device, the method comprising at least the following steps:

the device is placed in a vacuum chamber and is kept under a vacuum;

a predetermined volume of fluid is inserted in the cylindrical tank; and the cylinder tank is closed under a vacuum;

characterized in that said predetermined volume of fluid is measured by measurement means external to the device of the invention and may have any value that is not greater than the total volume of said cylindrical tank.

The device may include resilient means urging the piston towards its closure position.

In an advantageous embodiment, at rest said piston is in sealing contact with said ring around a peripheral line close to the cylindrical wall of the tank so that only a radially outer portion of the piston is initially exposed to the pressure that obtains inside the tank, such that the section of the piston which is exposed to the pressure that obtains inside the tank increases suddenly when the piston separates from the ring, thereby encouraging clean opening of communication between the tank and the outlet passage.

In another embodiment which is applicable to any device of the general type specified in the introduction, it includes locking means that prevent the pusher from moving axially relative to the tank. Advantageously, said locking means are unlockable by rotating the pusher relative to the tank. Advantageously, the locking means remain blocked in the unlocked position after they have been unlocked. The locking means may be constituted by at least one breakable bridge of material between the pusher and the tank.

In an embodiment that may be applied to any device of the general type specified in the introduction, means for preventing involuntary actuation thereof. Advantageously, it includes at least one zone of breakable material that forms an abutment opposing actuation and that is broken during actuation.

In an embodiment that may be applied to any device of the general type specified in the introduction it includes means for preventing the tank from being separated from the pusher. Advantageously, said means include snap-fastening means that are in the snap-fastened position at least while the device is in its rest position. Advantageously, said snap-fastening means are also in the snap-fastened position when the device in its end-of-actuation position.

The present invention also provides a method of filling the above-mentioned device, the method comprising at least the following steps:

the device is placed in a vacuum chamber;

a predetermined volume of fluid is inserted in the cylindrical tank;

the vacuum chamber is evacuated; and the cylindrical tank is closed under vacuum; characterized in that said predetermined volume of fluid is measured by measurement means external to the device of the invention and may be of any value that is not greater than the total volume of said cylindrical tank.

BRIEF DESCRIPTION OF THE DRAWING

Other characteristics and advantages of the invention appear from the following detailed description of various embodiments of the invention given as non-limiting examples, and with reference to the accompanying drawings.

In the drawings:

FIG. 2 is a perspective view of the FIG. 1 device;

FIG. 3 is a detail view of a portion of the FIG. 1 device;

FIG. 3A is a view of the underside of the ring 10 in FIG. 3, as seen looking along A in FIG. 3;

FIG. 4 is a fragmentary longitudinal section view through the device of FIG. 1 in its end-of-actuation position; while FIG. 4A is an expanded view of select portions of FIG. 4.

FIG. 15 is a side view of another variant of the device of the invention;

FIG. 16 is a fragmentary, section view through another variant of the device of the invention.

DETAILED DESCRIPTION OF THE PREFERRED EMBODIMENTS

Figure 1:
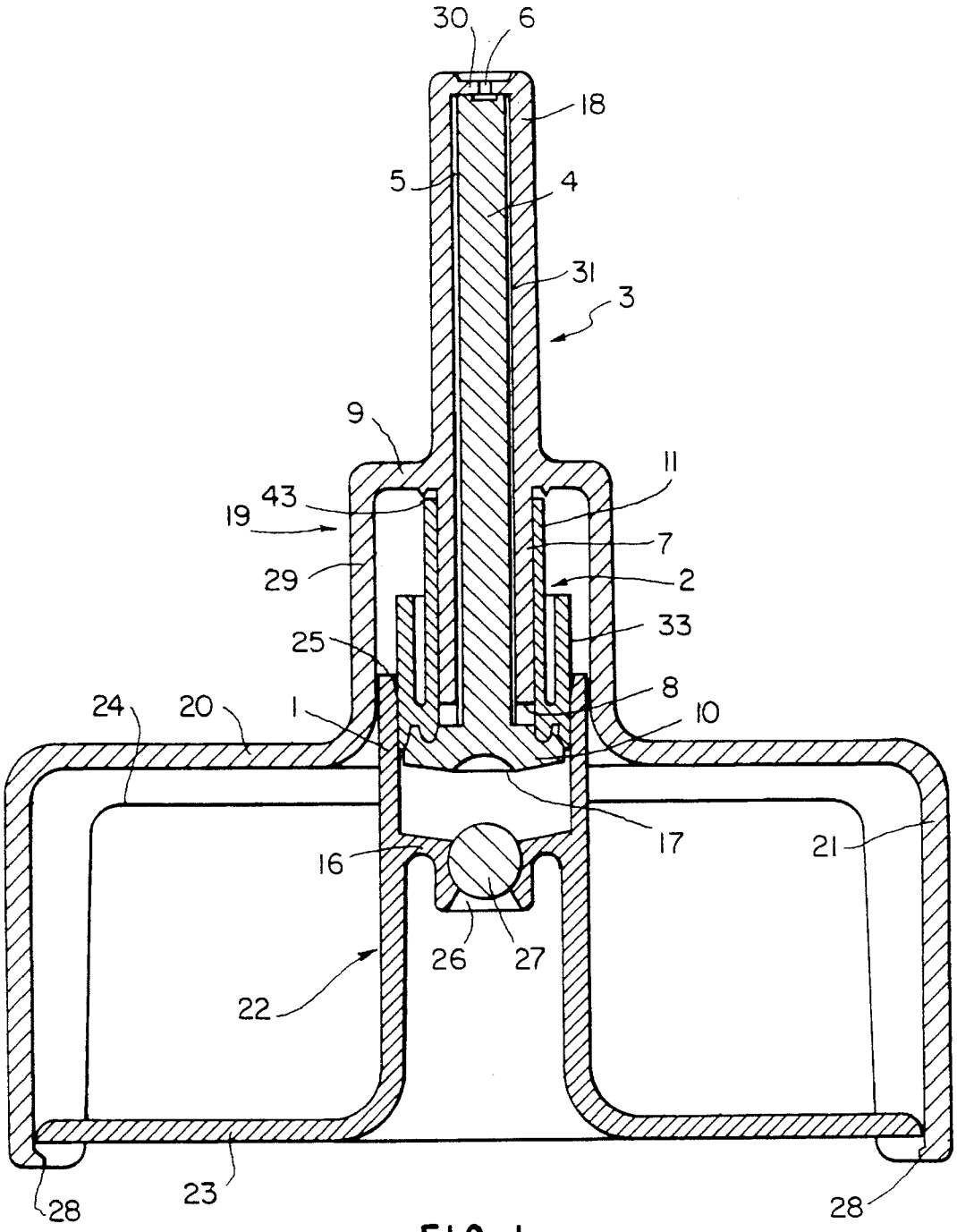
FIG. 1 is a longitudinal section view through an embodiment of the device of the invention, in its storage position.

FIGS. 1 to 4 show a first embodiment of the device of the invention. This device is designed to spray a single dose of a fluid, generally of the order of a few milliliters. The device of the invention is thus small in size, and measures a few centimeters in its greatest dimension. It is generally made of a plastics material.

As shown in FIG. 2, the device of the invention includes a pusher 3 provided with an outlet endpiece 18 having an enlarged base 19 from which there extends radially outwardly a thrust surface 20 that is in turn extended by a skirt 21. A pump body 22 is mounted inside the skirt 21 and includes thrust wings 23 adapted to slide inside said skirt 21. The device may be actuated by being held between the thumb and one or two fingers, the thumb being pressed against the thrust wings 23 and the other fingers being pressed against the thrust surface 20. To facilitate actuation, the skirt 21 generally includes a recess 24 for receiving the thumb.

With reference to FIG. 1, the pump body 22 includes a cylindrical tank 1 which extends between an open end 25 and an end wall 16 provided with a filler orifice 26. The filler orifice 26 may be dosed by a bead 27 that constitutes a force-fit inside said orifice, or by any other plug means. Advantageously, the skirt 21 of the pusher 3 has an inwardly-directed snap-fastening lip 28 on its free end that serves to keep said thrust wings 23 inside said skirt 21.

The enlarged base 19 of the outlet endpiece 18 is constituted by a cylindrical wall 29 disposed around the cylindrical tank 1 and which extends between the thrust surface 20 and annular wall 9 which itself extends radially inwards to the outlet endpiece 18. The outlet endpiece 18 extends between said annular wall 9 and an outlet end 30 including an outlet orifice 6. The outlet endpiece 18 is hollow and it projects a certain distance inside the cylindrical wall 29 of the enlarged base 19 in the form of a cylindrical wall 7 that extends to an end 8. Thus, the outlet endpiece 18 and the cylindrical wall 7 delimit a cylindrical longitudinal channel 31 in communication with the outlet orifice 6.

A rod 4 that is also cylindrical is a force-fit inside the longitudinal channel 31. The rod 4 extends from a first end 32 placed in contact with the outlet end 30 of the outlet endpiece 18 to beyond the end 8 of the cylindrical wall 7, at which point said rod 4 extends radially outwards in the form of a ring 10. The rod 4 includes one or more outside grooves 5 extending along its entire height and in communication with the outlet orifice 6, generally via grooves formed in the first end 32 of the rod 4 in well-known manner.

The device of the invention also includes a piston 2 that slides in the cylindrical tank 1 and that is capable of sliding over the cylindrical wall 7 of the pusher between the ring 10 and the abutment-forming annular wall 9. In the example shown in FIG. 1, the piston 2 includes an internal sleeve 11 that extends to a free end 43 close to the annular wall 9 of the pusher and that slides over the cylindrical wall 7. In addition, the piston 2 includes an outer skirt 33 that slides in sealed manner inside the cylindrical tank 1.

FIG. 3 is a detail view showing the structure of the piston 2 and of the ring 10. The ring 10 includes an annular rib 12 facing towards the piston, and the piston 2 includes an annular groove 13 facing towards the annular rib 12. The annular groove 13 of the piston is inwardly delimited by a rib 14 and outwardly by a peripheral outer sealing lip 34 of the skirt 33 which slides in sealed contact inside the cylindrical tank. The ring 10 also includes a groove 15 adapted to receive said rib 14. When the piston 2 is in a storage position, as shown in FIG. 3, the annular rib 12 of the ring 10 is a force-fit in the annular groove 13 of the piston, and is wedged between the sealing lip 4 and the rib 14 of the piston. During assembly of the device, the piston 2 is initially assembled on the ring 10 by engaging the annular rib 12 in the groove 13. Then the rod 4 is forced into the longitudinal channel 31 of the pusher and the piston 2 is inserted into the cylindrical tank 1. To facilitate such insertion, the cylindrical tank 1 advantageously includes an inside chamfer 41 at its open end. When the sealing lip 34 is inset-ted in the chamfer 41, it is progressively deformed radially inwards so as to clamp against the rib 12 which is thus compressed between the rib 14 and the lip 34.

In the particular example shown in FIGS. 3 and 3A, contact between the lip 34 and the rib 12 is not sealing contact since the ring 10 includes one or more slots 40 in its outer periphery, thus putting the tank of fluid 1 into communication with the groove 13 of the piston. In this example, sealing between the piston 2 and the ring 10 is provided by contact between the rib 14 and the groove 15. This sealing is reinforced by the radial damping due to the sealing lip 34 which presses the rib 12 between the rib 14. Thus, the rib 14 is also wedged in the groove 15 and participates in wedging the piston 2 on the ring 10.

Although they are advantageous for reasons explained below, the slots 40 may be omitted.

Figure 3B:
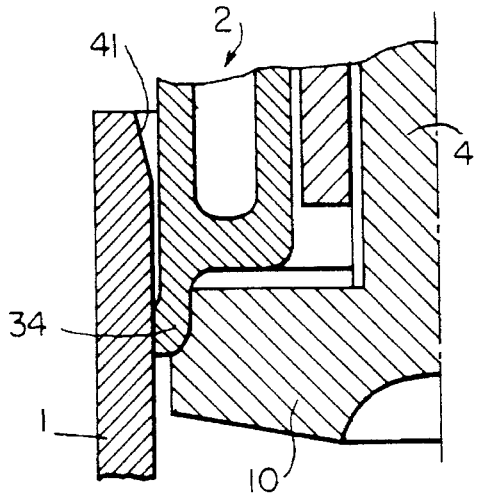
FIG. 3B is a view similar to FIG. 3, showing a variant of the device of the invention.
Figure 8:
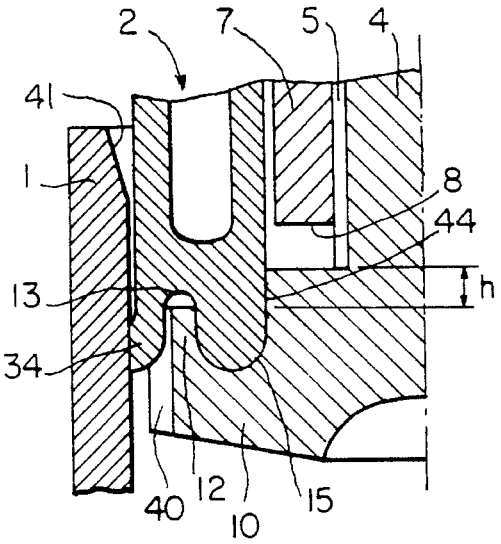
FIG. 8 is a section view similar to FIG. 3 for a variant of the invention that is particularly adapted to the configurations of FIGS. 6 and 7.

Optionally, as shown in FIG. 3B, the wedging and the sealing between the piston 2 and the ring 10 may be provided by contact between the sealing lip 34 and the ring 10, providing said ring 10 no longer includes any slots 40. It is then no longer necessary to provide a rib or a groove on the piston 2 or on the ring 10.

When the user holds the device between the thumb and two fingers, and presses simultaneously on the thrust wings 23 of the pump body 22 and on the thrust surface 20 of the pusher 3, the piston 2 tends to move down together with the pusher 3 towards the end wall 16 of the cylindrical tank 1. The fluid contained in the cylindrical tank 1 is generally incompressible, such that the pressure of said fluid increases without significant displacement of the pusher 3 relative to the pump body 22. This pressure exerts a force on the piston 2 tending to move it away from the end wall 16 of the cylindrical tank 1. When the ring 10 includes the slots 40 of FIG. 3, the pressure of the fluid acts on a greater area of the piston and thus the force applied to the. piston by said pressure is correspondingly increased, thereby facilitating release of the piston 2. Once said force is sufficient to disconnect the piston 2 from the ring 10, the piston 2 is pushed back upwards while the pusher 3 together with the rod 4 and the ring 10 begins to move downwards towards the end wall 16 of the cylindrical tank 1. In this way, the internal sleeve 11 of the piston 2 is pushed into abutment against the annular wall 9 of the pusher 3, and a space 35 is established between the piston 2 and the ring 10, as shown in FIG. 4. When the sleeve 11 is brought into abutment against the annular wall 9 under the effect of the pressure that obtains inside the fluid tank 1 and of the friction between the piston 2 and said tank 1, then contact between the sleeve 11 and the annular wall 9 is sealing contact. Advantageously the annular wall 9 includes an annular lip surface 42, that is clearly visible in FIG. 4A, that surrounds the cylindrical wall 7, and that forms an acute angle with said cylindrical wall 7. The free end 43 of the sleeve 11 comes into abutment against said surface 42 so that by the wedging effect, the surface 42 deforms the free end 43 of the sleeve 11 radially inwards, and presses it against the cylindrical wall 7 of the pusher. In addition, this deformation is accompanied by considerable pressure being applied by the surface 42 to the sleeve 11. Thus, the free end 43 of the sleeve 11 is in sealing contact with both the annular surface 42 and the cylindrical wall 7.

The space 35 puts the cylindrical tank 1 into communication with the grooves 5 on the rod 4, such that the fluid contained in said cylindrical tank 1 can be expelled via the passage 35, the grooves 5, and the outlet orifice 6, while the piston 2 and the ring 10 move down inside said cylindrical tank 1 towards the end wall 16. This motion comes to an end when the ring 10 comes into abutment against said end wall 16. Advantageously, the ring 10 includes a face 17 facing towards the end wall 16 and which is substantially complementary in shape to the shape of said end wall 16 and of the bead 27, such that when the ring 10 is in abutment against the end wall 16, substantially all of the fluid contained in the cylindrical tank 1 has been expelled. This serves to limit the loss of a fraction of the fluid contained in the cylindrical tank, which is particularly useful when the fluid is expensive, or when its use is subject to regulations (e.g. medicines based on prohibited drugs).

Figure 5:
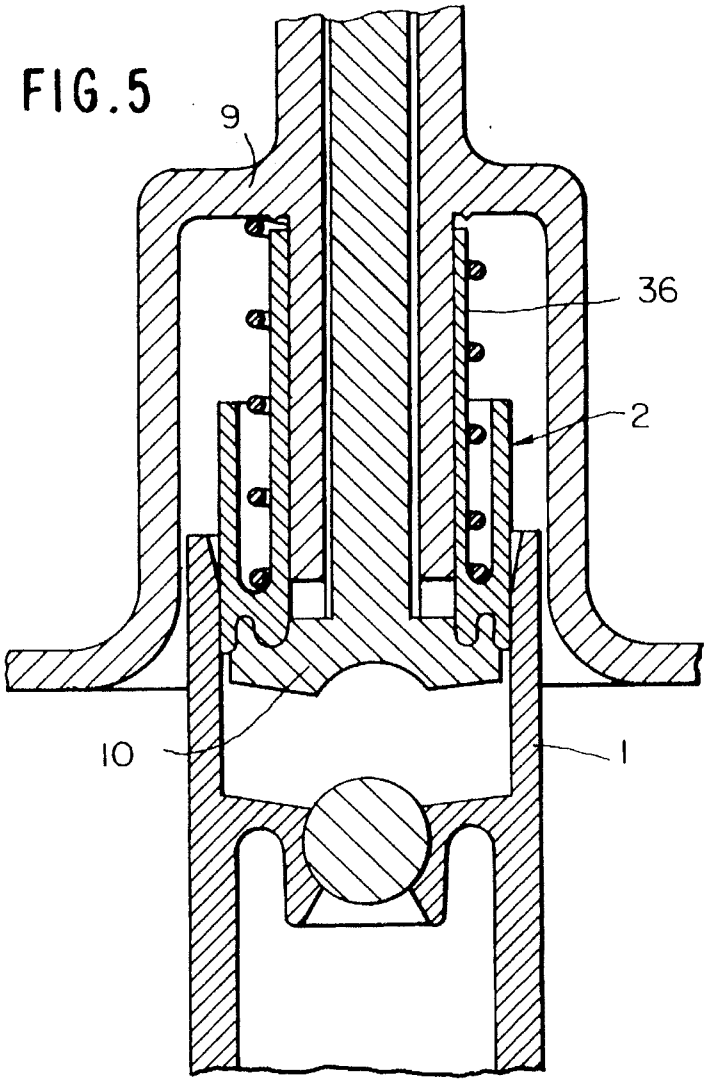
FIG. 5 is a fragmentary view in longitudinal section through a variant device of the invention in its storage position.

FIG. 5 shows a variant of the FIG. 1 device in which resilient means such as a helical spring 36 are disposed between the annular wall of the pusher 3 and the piston 2 so as to urge the piston 2 resiliently towards the ring 10. This variant may be used advantageously, in particular when the volume of the dose to be sprayed is relatively large, and where the stroke of the piston 2 in the cylindrical tank 1 is relatively large. Under such circumstances, it could happen that a user might interrupt or slow down the motion of the piston 2 inside the cylindrical tank 1 during the stroke of said piston 2. Under such circumstances, the pressure inside the cylindrical tank 1 would fall off and the helical spring 36 would urge the piston 2 towards the ting 10 isolating the cylindrical tank 1 again from the outlet grooves 5. The piston 2 would then move away from the ting 10 only once the pressure inside the cylindrical tank 2 has again become sufficient to overcome the force of the spring 36. This serves to guarantee that the fluid leaves the device in the form of a fine spray. Furthermore, the helical spring 36 reinforces the wedging of the piston 2 against the ring 10 when said piston is in its storage position.

Figure 6:
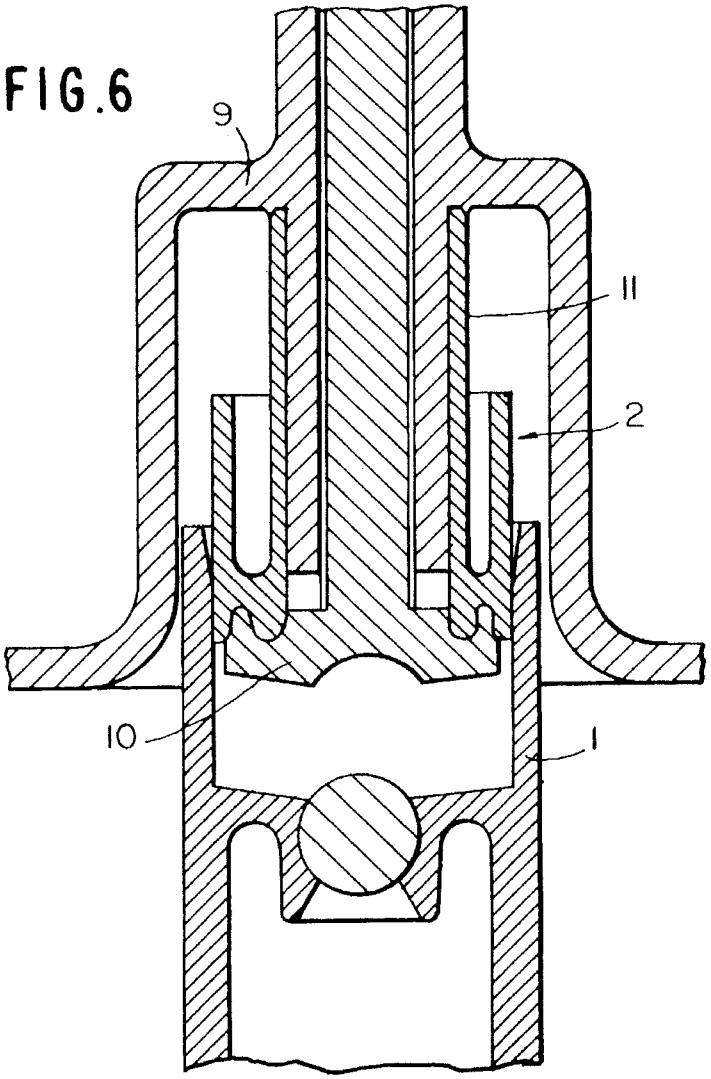
FIG. 6 is a fragmentary longitudinal section view through another variant of the device of the invention in its storage position.
Figure 7:
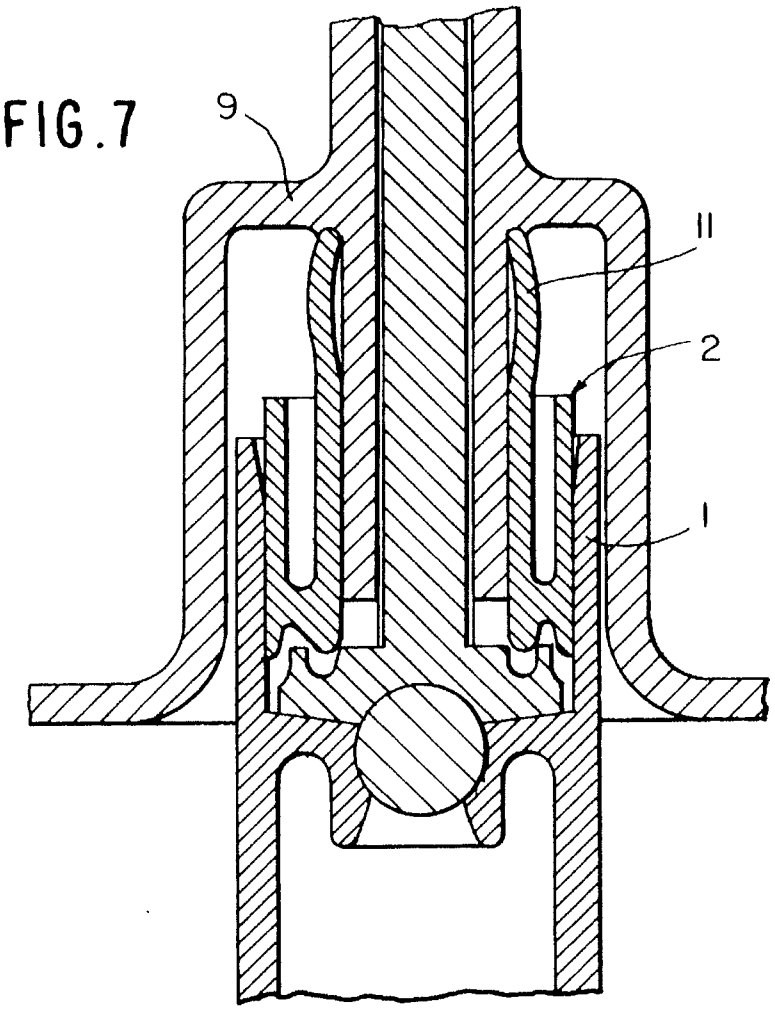
FIG. 7 is a fragmentary longitudinal section view through the FIG. 6 devices in its end-of-actuation position.

FIGS. 6 and 7 show another variant of the device of the invention in which the internal sleeve 11 of the piston 2 is placed in abutment against the annular wall 9 when the piston is in its storage position. Thus, displacement of the piston towards its actuation position, as shown in FIG. 7, is achieved by deforming a portion of the internal sleeve 11 of the piston radially inwards in the vicinity of the annular wall 9 of the pusher.

In this variant of FIGS. 6 and 7, it is particularly advantageous for the ring 10 to include a cylindrical surface 44 over which a complementary cylindrical portion of the piston slides in sealing contact. If the height of the cylindrical surface 44 is written h, the piston 2 must move away from the ring 10 by the distance h before releasing a passage between the fluid tank 1 and the outlet grooves 5. This distance h travelled by the piston corresponds to a predetermined compression of the sleeve 11 which itself corresponds to a predetermined force exerted by the sleeve 11 on the piston 2: thus, it is ensures that the fluid is expelled only providing the pressure inside the tank 1 has reached a predetermined value, thereby ensuring that the fluid is sprayed finely.

Figure 9:
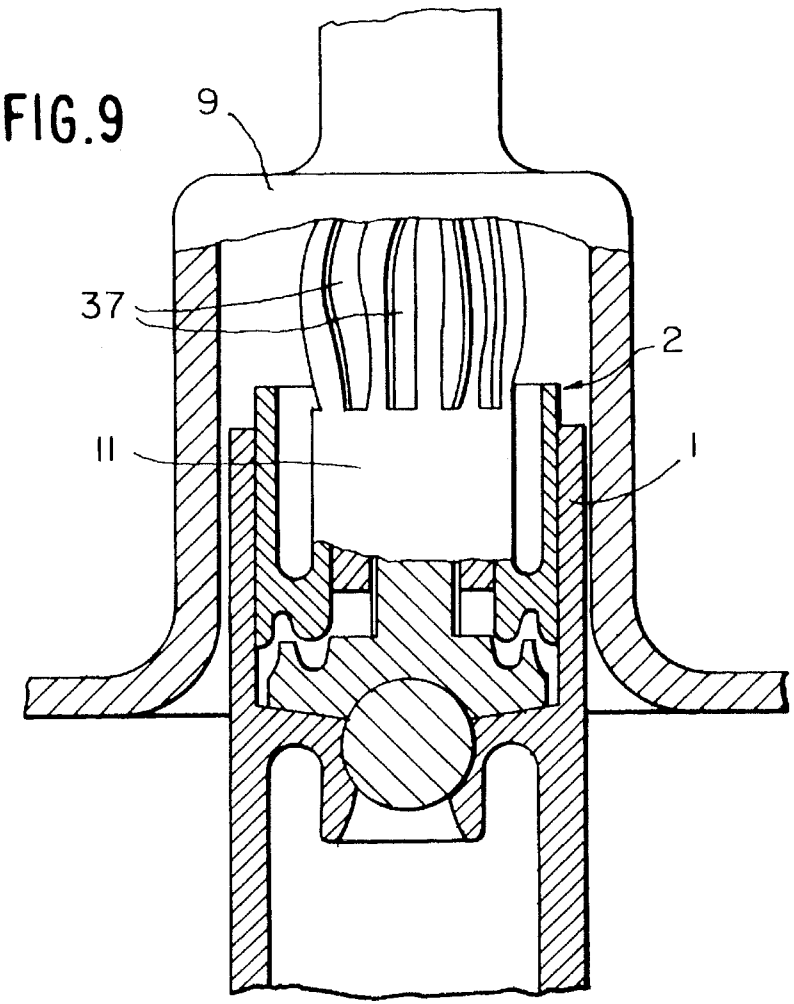
FIG. 9 is a fragmentary longitudinal section view through another variant of the device of the invention in its end-of-actuation position.

FIG. 9 shows a variant of the device of FIGS. 6 and 7 in which the internal sleeve 11 of the piston includes longitudinal slits 37 which extend over a fraction of its length in the vicinity of the annular wall 9 of the pusher 3, thereby facilitating deformation of said internal sleeve 11.

Figure 10:
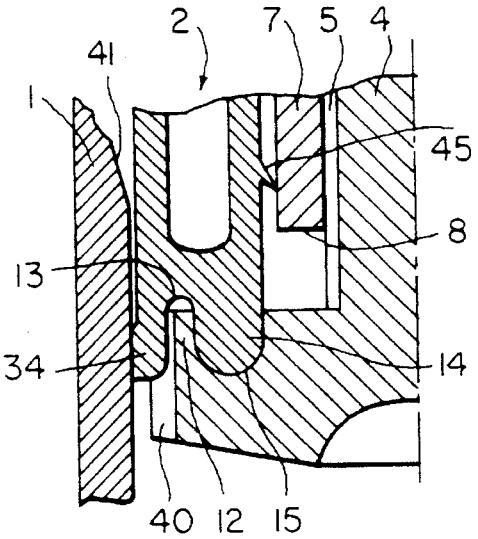
FIG. 10 is a detail view of the FIG. 9 device.

In the variant of FIG. 9, sealing between the piston 2 and the pusher can no longer be provided at the annular wall 9. It is therefore possible to provide a peripheral sealing lip 45 between the sleeve 11 of the piston and the cylindrical wall 7 of the pusher, as shown in FIG. 10. This lip 45 may be formed on the inside of the sleeve 11, for example, but it could also be formed outside the cylindrical wall 7. It will be observed that the above-described variants of the device of the invention could also be fined with the sealing lip 45 as a replacement for the sealing by abutment between the sleeve 11 and the wall 9.

The device of the invention may be filled with fluid by performing the following method:

the device is placed in a vacuum chamber, with the orifice 26 of the tank 1 pointing upwards;

the vacuum chamber is evacuated;

a volume of fluid as measured by external measurement means is inserted into the cylindrical tank 1, said volume being less than the total volume of said cylindrical tank 1; and the orifice 26 is plugged under a vacuum.

The step of evacuating the chamber may take place after the step of inserting an externally measured volume of fluid in the tank 1.

Thus, the volume of fluid inserted into the tank 1 is selected to lie in the range 0 to a maximum volume. This is particularly advantageous insofar as the same spray device of the invention can be used to contain various doses of fluid, thus enabling it to be manufactured in large quantities and thus at reduced cost. After the orifice 26 has been plugged and after the device has been removed from the vacuum chamber, if the volume of fluid is less than the total volume of the tank 1, then the piston 2 slides into the tank 1 under drive from external atmospheric pressure until the inside volume of the tank 1 becomes substantially equal to the volume of fluid that it contains.

Figure 11:
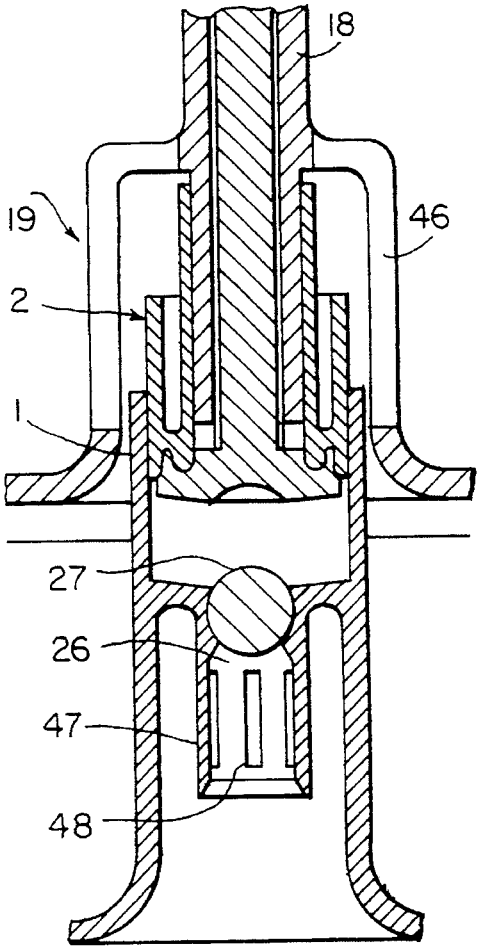
FIG. 11 is a section view through another variant of the device of the invention.

As shown in FIG. 11, the enlarged base 19 of the endpiece 18 may include slits 46 enabling the position of the tank 1 relative to the piston 2 to be adjusted accurately so as to fix the maximum volume of fluid that can be contained in said tank 1 accurately.

In addition, the slits 46 make it possible to press against the piston 2 and not against the piston 3 while said piston is being installed inside the cylindrical tank 1. This prevents the piston 2 from leaving its storage position during installation, because of the friction between said piston and the cylindrical tank 1.

Advantageously, the orifice 26 in the end wall 16 may be extended outwards by a duct 47 provided with longitudinal slits 48. Thus, the bead 27 can be partially inserted into the duct 47 without closing the orifice 26 which is then in communication with the outside via the slits 48. The manufacturer who fills the tank 1 is generally not the manufacturer of the device itself, and under such circumstances the filling manufacturer needs merely to push the bead 27 in as far as the orifice 26 in order to plug said orifice after the tank 1 has been filled.

Figure 12:
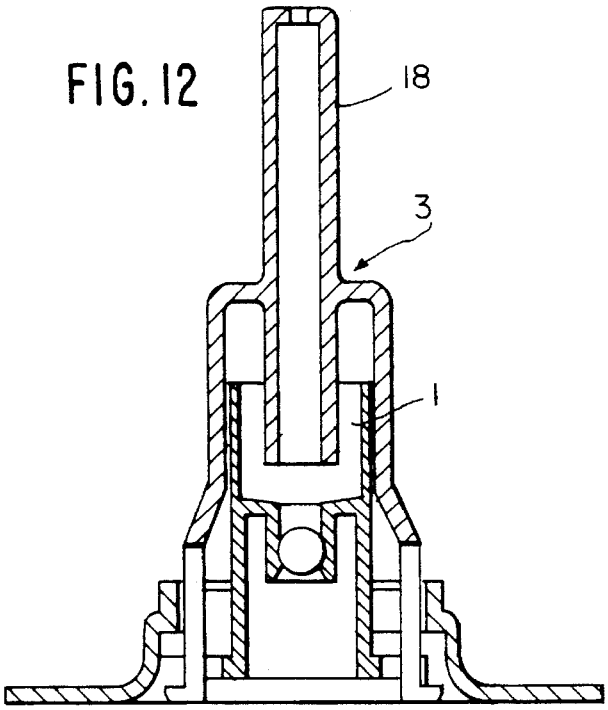
FIG. 12 is a diagrammatic longitudinal section view through a variant of the device of the invention, in its end-of-actuation position, the rod 4 and the piston 2 being omitted.
Figure 13:
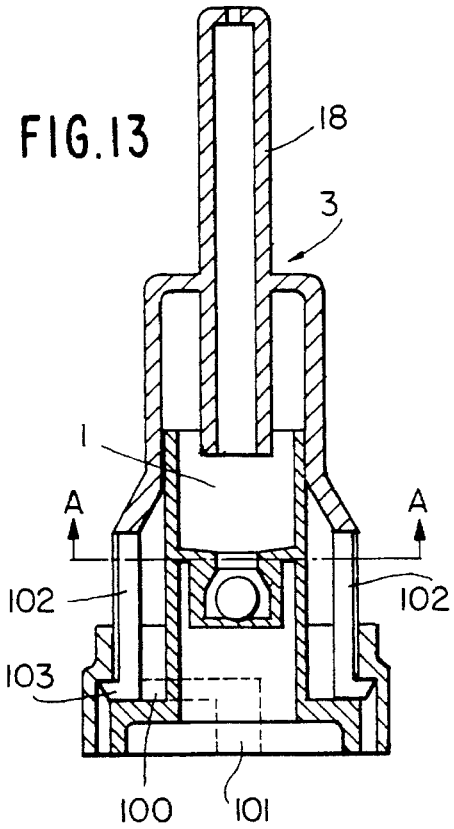
FIG. 13 is a side view in longitudinal section through the FIG. 12 device in its storage position.
Figure 14:
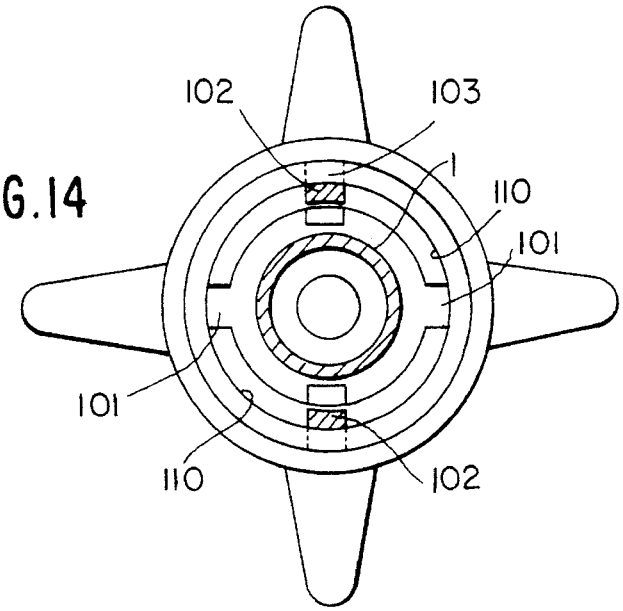
FIG. 14 is a section view on line A—A of the FIG. 13 device.

FIGS. 12 to 14 show a variant of the invention that seeks to provide a more reliable guarantee that the device remains in its storage position. For greater clarity, the piston 2 is not shown, nor is the rod 4 or the ring 10. For this purpose, the tank 1 includes two grooves 100 in a plane perpendicular to the axis of the device, and each groove 100 communicates at one of its ends with an axial groove 101 going away from the pusher 3. In addition, the pusher 3 includes two substantially axial resilient arms 102 each of which extends as far as a free end that is provided with a catch 103 that, in the rest position, penetrates into a groove 100 at its end that does not communicate with an axial groove 101. In the rest position, the pusher 3 is thus held in place axially relative to the tank 1. To actuate the device, the pusher 3 is rotated relative to the tank 1 through about one-fourth of a turn, until the catches 103 face the axial grooves 101.

During such rotation, the resilient arms 102 are pushed radially inwards by ramps 110 formed in the bottoms of the grooves 100, and at the end of rotation the catches snap into the axial grooves 101 such that the pusher can no longer be returned to its storage position. This makes it easy to see whether a device has already been used.

In FIG. 15, a spot weld 104 is made between the pusher 3 and the tank 1 in order to guarantee that these two parts do not move relative to each other during storage or transport, and to show up any opening of the device or actuation of the device since the spot weld 104 is broken during opening or actuation.

In FIG. 16, the device includes an anti-opening safety mechanism constituted by resilient catches 105 snapped into orifices 106 of the pusher while the device is in its storage position. The catches have a bottom face **105*a* with the normal thereto extending axially away from the outlet 30 of the pusher 3, and a top sloping face 105*b* whose normal has an axial component directed towards the endpiece 18 and a radial component directed towards the outside. The bottom face 105***a* comes into abutment against the wall of the pusher, preventing the tank 1 from being withdrawn, whereas when the tank 1 is urged towards the outlet 30 of the pusher, the sloping face 105*b* pushes the corresponding catch 105 radially inwards, thereby disengaging the orifice 106 thus enabling actuation to take place. Advantageously, the pusher 3 further includes orifices 107 in which the catches 105 are engaged when the device is in its end-of-actuation position, so that the tank 1 cannot be opened for the purpose of being refilled. Under such circumstances, it is advantageous for the tank 1 to be guided in its axial motion relative to the pusher 3 in such a manner that the catches 105 are certain to penetrate into the orifices 107.

Figure 17:
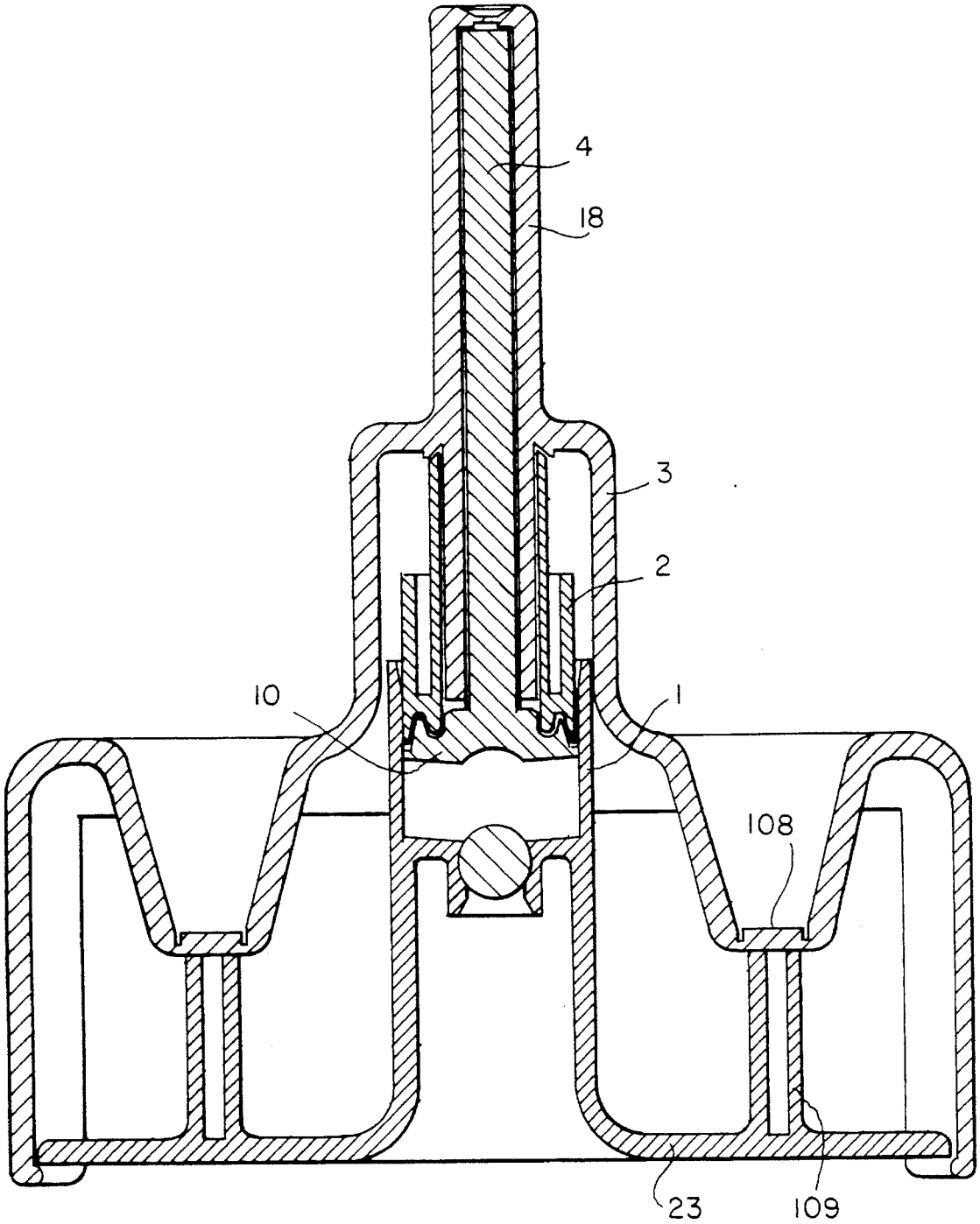
FIG. 17 is a section view through another variant of the device of the invention.

In FIG. 17, the pusher 3 includes removable pellets 108 and the tank 1 includes corresponding axial rods 109 that punch out the pellets 108, detaching them from the pusher 3 during actuation. This prevents untimely actuation during storage or transport, and detached pellets 108 demonstrate the device has already been actuated.

It may be observed that the variants of FIGS. 12 to 17 could be applied to a device in which the piston is not held in place by wedging, and more generally to any device of the same general type as that of the invention having a cylindrical tank, and a piston which is secured to a pusher and which is provided with an outlet passage.

What is claimed is:

1. A device for spraying a single dose of a fluid in divided form, the device comprising at least:

a cylindrical tank (1) containing said single dose of fluid;

a piston (2) slidable in a sealed manner in said cylindrical tank (1);

a pusher for actuating the piston (2); and an outlet passage (5, 6) capable of communicating with said cylindrical tank (1) wherein said piston (2) is slidably mounted on said pusher and is displaceable relative to said pusher between a storage position in which it seals said cylindrical tank and prevents communication between said outlet passage (5, 6) and said cylindrical tank (1), and an actuation position in which it puts said outlet passage (5, 6) into communication with the cylindrical tank (1), the piston being placed so that a pressure obtaining in the cylindrical tank (1) attracts the piston (2) towards its actuation position, and wherein the piston (2) is held in its storage position by wedging, on the pusher, and can be displaced towards its actuation position only if the pressure that obtains inside the cylindrical tank is sufficient for unwedging it, said pressure being obtained by pushing on the pusher.

2. A device according to claim 1, further characterized in that the pusher (3, 4) comprises cylindrical portion (7) that extends between an end (8) close to the cylindrical tank (1) and an abutment (9) that is further from the cylindrical tank (1), said end (8) close to the fluid tank is secured to a ring (10), said fluid outlet passage (5, 6) is disposed at least in part inside said cylindrical portion (7) of the pusher, said fluid outlet passage opens out from said cylindrical portion (7) between said ring (10) and said abutment (9) in the vicinity of said ring (10), the piston includes an internal sleeve (11) that slided over said cylindrical portion (7) of the pusher and said piston (2) is in sealing contact with said ring (10) while in the storage position.

3. A device according to claim 2, further characterized in that the piston (2) includes an outside peripheral sealing lip (34) which slides in sealed manner inside the cylindrical tank (1) and which is wedged between said tank (1) and the ring (10) when the piston (2) is in its storage position.

4. A device according to claim 3, further characterized in that the ring (10) includes an annular rib (12) extending towards the piston (2), the piston includes an annular groove (13) adapted to receive the rib (12) of the ring, the piston (2) includes an annular rib (14) directed towards the ring (10) and inside said annular groove (13), and the ring (10) includes an annular groove (15) adapted to receive the annular rib (14) of the piston (2).

5. A device according to claim 4, further characterized in that the (10) includes at least one passage (40) putting the tank (1) into communication with the groove (13) of the piston (2) when said piston (2) is in its storage position, and in that the rib (14) of the piston is in sealing contact with the groove (15) of the ring (10).

6. A device according to claim 2, further characterized in that the cylindrical tank (1) includes an end wall (16), and the ring (10) includes a face (17) facing towards said end wall (16) and substantially complementary in shape to said end wall (16), and in that said face (17) of the ring (10) comes into abutment against said end wall (16) at the end of the stroke of the piston (2), such that substantially all of the fluid contained in the tank (1) is expelled.

7. A device according to claim 2, further characterized in that the piston (2) is urged towards its storage position by resilient means (36, 11).

8. A device according to claim 2, further characterized in that internal sleeve (11) of the piston (2) presses against the abutment (9) of the pusher when the piston (2) is in its storage position, and the displacement of the piston (2) towards its actuation position takes place by deformation of at least a portion of the internal sleeve (11).

9. A device according to claim 8, further characterized in that the internal sleeve (11) of the piston (2) includes longitudinal slits (37) over a fraction of its length in the vicinity of said abutment (9) of the pusher so as to facilitate deformation of said internal sleeve (11).

10. A device according to claim 2, further characterized in that the sleeve (11) is pressed in sealed contact against said abutment (9) when the piston is in its actuation position.

11. A device according to claim 10, further characterized in that said abutment (9) includes a concave annular surface (42) surrounding the cylindrical wall (7) with its concave side facing towards the sleeve (11), and in that said concave annular surface (42) deforms a free end (43) of said sleeve (11) radially towards the inside when the piston (2) is its actuation position.

12. A device according to claim 2, further characterized in that the sleeve (11) of the piston (2) slides in sealed manner over the cylindrical wall (7) of the pusher.

13. A device according to claim 2, further characterized in that the piston (2) includes a cylindrical portion (14) which slides over a complementary cylindrical portion (15) of the ring (10) while continuing to interrupt communication between the cylindrical tank (1) and the fluid outlet passage (5, 6) so long as the piston (2) has not moved away from the ring (10) by a predetermined distance (h).

14. A device according to claim 2, further characterized in that at rest said piston (2) is in sealing contact with said ring (10) around a peripheral line close to the cylindrical wall of the tank (1) so that only a radially outer portion of the piston is initially exposed to the pressure that obtains inside the tank (1), such that the section of the piston (2) which is exposed to the pressure that obtains inside the tank increases suddenly when the piston (2) separates from the ring (10), thereby encouraging clean opening of communication between the tank (1) and the outlet passage (5, 6).

15. A device according to claim 1, further characterized in that the cylindrical fluid tank (1) includes a filler orifice (26)

suitable for receiving a plugging bead (27), and said orifice (26) is extended towards the outside of the tank (1) by a duct (47) provided with longitudinal slits (48), said bead (27) being capable of being received as a force-fit inside said duct (47) in an intermediate position where it allows the tank (1) to communicate with the outside via said longitudinal slits (48).

16. A device according to claim 1, further characterized in that it includes resilient means (36, 11) urging the piston (2) towards a respective closure position.

17. A device according to claim 1 further characterized in that it includes locking means that prevent the pusher (3) from moving axially relative to the tank (1).

18. A device according to claim 17, further characterized in that said locking means (100, 103) are unlockable by rotating the pusher (3) relative to the tank (1).

19. A device according to claim 18, further characterized in that the locking means (100, 103) remain blocked in the unlocked position after they have been unlocked.

20. A device according to claim 17, further characterized in that said locking means are constituted by at least one breakable bridge of material (104) between the pusher (3) and the tank (1).

21. A device according to claim 1, further characterized in that it includes means for preventing involuntary actuation thereof.

22. A device according to claim 21, further characterized in that it includes at least one zone of breakable material (108) that forms an abutment opposing actuation and that is broken during actuation.

23. A device according to claim 1, further characterized in that it includes means for preventing the tank (1) from being separated from the pusher (3).

24. A device according to claim 23, further characterized in that said means include snap-fastening means (105) that are in the snap-fastened position at least while the device is in its rest position.

25. A device according to claim 24, further characterized in that said snap-fastening means are also in the snap-fastened position when the device in its end-of-actuation position.

* * * * *